United States Patent [19]

Allen et al.

[11] 4,171,062

[45] Oct. 16, 1979

[54] CONTAINER HAVING CLOSURE FASTENING MEANS

[75] Inventors: David O. Allen, Wilmington; Harry A. E. Wombold, Dayton, both of Ohio

[73] Assignee: Buckeye Molding Company, New Vienna, Ohio

[21] Appl. No.: 878,607

[22] Filed: Feb. 16, 1978

[51] Int. Cl.[2] ..... B65D 41/32

[52] U.S. Cl. ..... 220/270; 220/319; 220/306

[58] Field of Search ..... 220/266, 270, 315, 319, 220/320, 324, 306; 215/32, 224, 256, 316, 274

[56] References Cited

U.S. PATENT DOCUMENTS

| | | | |
|---|---|---|---|
| 3,415,412 | 12/1968 | Robinson et al. | 220/270 |
| 3,716,162 | 2/1973 | Botkin | 215/256 |
| 3,737,067 | 6/1973 | Palson | 220/324 |
| 3,858,748 | 1/1975 | Marco | 220/276 |
| 3,901,400 | 8/1975 | Westfall | 215/225 X |
| 4,024,976 | 5/1977 | Acton | 215/32 |
| 4,034,889 | 7/1977 | Hammes et al. | 220/324 X |

*Primary Examiner*—George T. Hall
*Attorney, Agent, or Firm*—Dybvig & Dybvig

[57] ABSTRACT

A container has means hingedly supporting a reversible band which surrounds the container near the mouth of the container. The hinged support for the band is engaged to that side edge of the band which is closest to the mouth of the container. The opposite side edge of the band has hook means associated therewith for interfitting rib means projecting outwardly from the skirt of a closure. The interfit between the container band and the closure rib is accomplished by swinging the band upwardly about its hinged edge connection to the container, whereupon the band is reversed in the sense that the inside face of the band initially closest to the container is turned outwardly from the container as the initially outside face of the band is turned inwardly toward the container, such reversal occurring as the band swings upwardly about its hinged connection to the container. Such reversal causes the initially outside face of the band to be enveloped by the initially inside face of the band with the consequence that the initially inside face of the band is placed under a substantial tensile stress which causes the band to collapse inwardly toward the container with the result that the hook portion of the band is drawn into firm interfitting engagement with the rib portion of the closure. The closure includes a severable panel secured initially to the closure skirt by a rupturable, tamper-indicating web and pry means associated with the severable panel for rupturing said web so as to allow removal of the panel and consequent access to the container contents.

13 Claims, 4 Drawing Figures

CONTAINER HAVING CLOSURE FASTENING MEANS

BACKGROUND OF THE INVENTION

The present invention relates to containers and closures and, in particular, to a container having integrally formed means for use in securing a closure to the container. It has been a common expedient to provide a container with an attached or integrally formed surrounding channel which receives and shields the lowermost edge of a closure skirt, thus to protect the resultant assembly against an inadvertent or surreptitious removal of the closure.

The prior art devices have typically provided the surrounding channel with one or more portions severable therefrom so that the severable portions when removed simplify access to the contents of the container and preferably leave telltale evidence that the container has been opened.

A difficulty with such prior art devices, particularly when applied to relatively pliant plastic containers and closures, is that the means by which the closure is assembled to the container is almost always reversible with the consequence that skillful manipulations can be employed to reverse the mode of container and closure assembly so as to allow one to gain access to the contents of the container and then reclose the container without leaving any evidence that the container has been entered.

An object of the present invention is to provide a container and closure assembly wherein the container has means formed integrally therewith for so securely anchoring an interfitting closure that a supplemental mode of container entry is required to be provided.

Another object of the present invention is to provide novel means integral with a container for securely anchoring a closure for the container.

Other objects and advantages will become apparent from the following description and the drawings.

SUMMARY OF THE INVENTION

In the present invention, a container formed of a pliant material such as plastic has an integrally formed band which surrounds the container adjacent the mouth thereof and which is hingedly connected to the container by a relatively thin connecting web. The container, which is preferably a molded plastic container, is provided with an initial configuration allowing easy ejection of the container from the mold in which it is formed. The "as molded" configuration of the container allows a band molded in surrounding relation to the container to be reversed, inside out in effect, without detachment from the container, by bending the band about its hinged connection to the container. Such bending places the initially inside face of the band under a substantial tensile force which compresses the band inwardly toward the container and interengages a hook portion formed integrally on the band with a rib portion provided on the skirt of a closure, thus to entrap the rib portion and thereby secure the closure to the container.

DESCRIPTION OF THE PREFERRED EMBODIMENT

Figure 1:
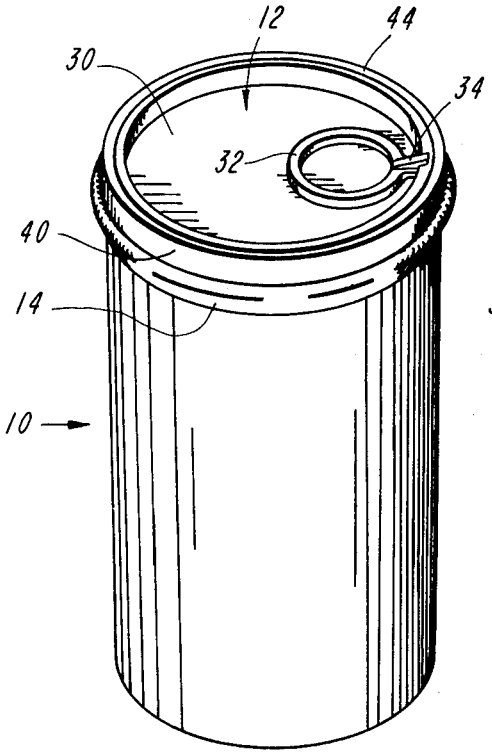
FIG. 1 is a perspective view illustrating an assembled closure and container in accordance with the present invention.
Figure 3:
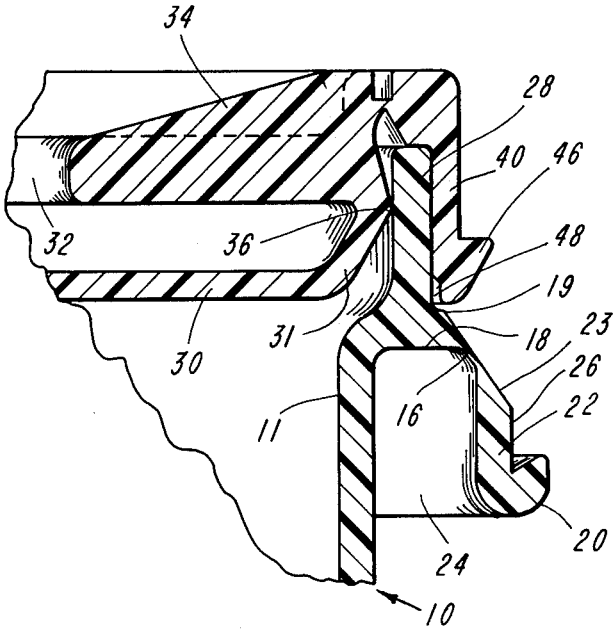
FIG. 3 is a section view analogous to that of FIG. 2 but illustrating an intermediate stage in the assembly of the container and closure of FIG. 1.

FIG. 1 illustrates a container 10 to which has been assembled a closure 12 retained by a band 14. Referring to FIG. 3, the closure 12 is shown in closing relationship to the container 10 before the band 14 has been manipulated for positive retention of the closure to the container.

The container 10 can be seen in FIG. 3 to comprise an upstanding wall 11 which turns radially outwardly to form a bead portion 18 which is downwardly spaced from the mouth of the container. Integrally connected to the radially outer end of the bead portion 18 is a web 16 which extends annularly around the container. Integrally attached to the web 16 is a thickened wall forming the band 14 which integrally supports at its lower end a hook portion 20 which surrounds the container 10.

The container 10 is preferably molded of a resilient thermoplastic material such as polyethylene, and the mold (not shown) in which the container 10 is molded has a frustum conical surface (not shown) which forms a beveled surface 19 at the radially outer end of the bead 18 and a beveled surface 23 at the upper end of the band 14. The two beveled surfaces 19 and 23 form a continuously flat frustum conical surface which also defines the upper surface of the relatively thin web 16 which extends between the bead 18 and the band 14.

It may be noted at this point that the band 14 which annularly surrounds the container 10 has an inside face 24 and an outside face 26. Due to the thickness of the band 14, the circumferential extent of the outside face 26 is necessarily larger than the circumferential extent of the inside face 24.

Extending upwardly from the bead 18 is an integrally formed annular wall 28 which defines a container mouth which is larger in diameter than is the upstanding wall 11 of the container. The annular wall 28 is sized to enter a skirt 40 depending from the closure 12.

Figure 2:
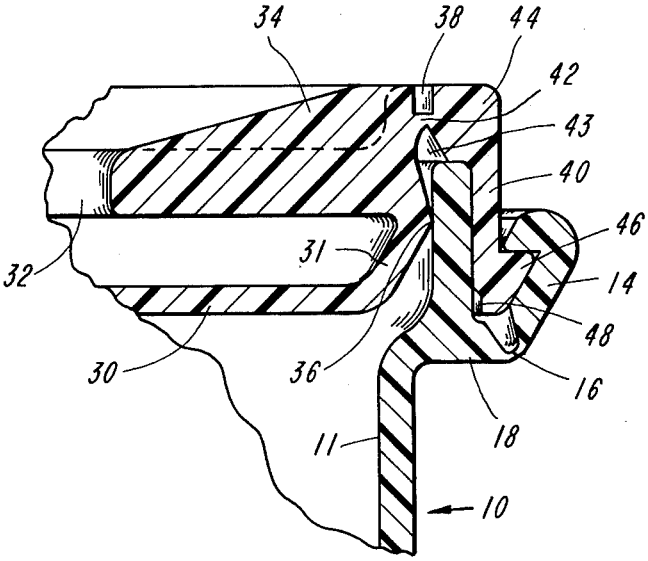
FIG. 2 is an enlarged section view of the assembled closure and container of FIG. 1 taken substantially along the diameter of the closure bisecting a pull ring that is an integral part of the closure.

As best seen in FIGS. 1 and 2, the closure 12 comprises a generally circular panel 30 having an upwardly turned margin 31 which forms a seal 36 for slidably engaging the internal surface of the container wall 28. The aforementioned skirt 40 is connected integrally to an upper portion of the annular margin 31 by means of an annular shoulder 44 adapted to seat against the upper end of the container wall 28.

The closure 12, which is generally of the type illustrated in U.S. Pat. No. 3,415,412, includes an integrally formed pull ring 32 supported interiorly of the shoulder 44 by means of a stiffening rib 34 formed integrally with the ring 32 and with the margin 31. The stiffening rib 34 and the annular shoulder 44 are spaced to form a notch 38. This notch is disposed above a rupturable web 42 integrally connecting the upper portion of the margin 31 to the shoulder 44. The thickness of the web 42 is determined by the upward extent of an annular score line or weakening groove 43 molded into the inside face of the closure 12 adjacent the shoulder 44. The designed thickness of the rupturable web 42 is adequate to sustain the integrity of the closure during the manufacture thereof and during the assembly of the closure to the container; but, as will be explained, the web 42 is designed so as to be thin enough to readily rupture under application of the forces to be described.

Those skilled in the art will appreciate that the closure has preferably been so designed that the aforementioned seal 36 cooperates with the aforementioned skirt 40 to establish a gap therebetween which is initially too small to receive the thickness of the container wall 28. However, the resilient nature of the molded closure 12, which is preferably a thermoplastic material such as polyethylene, allows the annular wall 28 to be pinched between the seal 36 and the skirt 40 as the closure 12 is pressed upon the container 10. To simplify the assembly of the closure 12 onto the container 10, the closure is provided with an annular internal notch 48 at the distal end of the skirt 40 which pilots the container wall 28 into the narrow space between the skirt 40 and the seal 36. The skirt 40 has an outwardly directed rib 46 formed integrally with the distal end of the skirt, whose function will now be described.

Assuming the container 10 to have been filled with a foodstuff or other substance which is to be stored therein and further assuming the closure 12 to have been applied to the container 10 by pressing the closure onto the container wall 28 to the position shown in FIG. 3, the band 14 with its integrally formed annular hook portion 20 is forced upwardly by an axial force applied thereabout, either manually or by machine, from the "as molded" or first position, to pivot the band upwardly and outwardly about the web 16. This movement will place the band 14 in a second position illustrated in FIGS. 2 and 4. Quite obviously, in the approach toward this second position, the band 14 is reversed in the sense that its inside face 24 must expand about and ultimately encircle the outside face 26. When such reversal occurs, the band 14 snaps sharply to its second position. As can be noted in FIGS. 2 and 4, the web 16, which anchors the initially upper end of the band 14, has been designed to be strong enough by reason of its thickness to allow the upward pivotal movement and reversal of the band 14 to take place without a rupture of the web 16 occurring.

Figure 4:
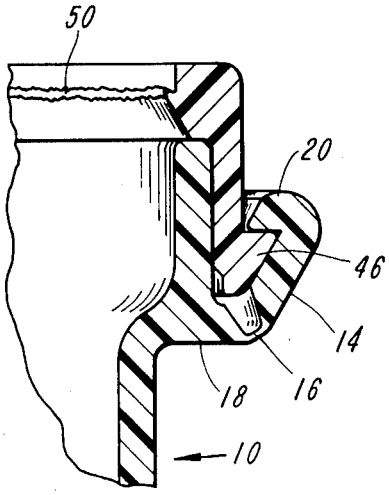
FIG. 4 is a section view analogous to that of FIG. 2 illustrating the assembled container and closure after disassembly of the closure so as to afford entry to the container.

Since the upward pivotal movement of the band 14 has turned the outer face 26 inside of the inner face 24, it can be appreciated that the initially inner face 24 has now been placed under a substantial tension along its circumference, and this tension tends to compress the initially outer face 26 inwardly toward the closure 12. The annular hook portion 20 formed on the band 14 has been so located in the design of the container 10 that, when the band 14 is pivoted upwardly as described, the hook portion 20 now serving as a clasping portion will encircle and firmly seat against to clasp the outwardly directed rib 46 formed at the distal end of the closure skirt 40. The interengaging condition between the hook portion 20 and the rib 46 provides a snug fit between the container and its closure which is not readily broken or reversed by manual manipulations. In the formation of this snug fit, it can be noted that the beveled surfaces 19 and 23 have swung one toward the other as is shown in FIGS. 2 and 4.

The resulting interfit between the closure 12 and container 10 is quite secure; and, in the ordinary utilization of such interfit, it is not intended that the closure 12 be removed from the container 10 by reversing or overcoming this powerful interfit. Instead, the closure 12 is provided with the previously described ring 32 with its integrally formed stiffening rib 34. Thus the present invention contemplates that access is gained to the contents of the container 10 by a finger manipulation which lifts the ring 32 and in so doing pivots the stiffening rib 34 upwardly so as to close the notch 38 adjacent the shoulder 44. Such closure enables the radially outer end of the stiffening rib 34 to pivot against the shoulder 44, now serving as a fulcrum, and thus rupture the rupturable web 42 adjacent the shoulder 44. Upon initial occurrence of such rupture, a continuing upward motion of the finger-manipulated ring 32 will progressively expand the rupture circumferentially about the inside of the shoulder 44 so as to tear the panel 30 free of the shoulder 44. FIG. 4 illustrates schematically the torn edge 50 remaining on the shoulder 44 after the web 42 has been ruptured by operation of the ring 32 and its integrally formed stiffening rib 34 as above described.

Although the preferred embodiments of this invention have been described, it will be understood that various changes may be made within the scope of the appended claims.

We claim:

1. In a molded plastic container, improved means for securing a closure to said container, comprising:

a circumferentially extending, reversible member integrally molded to the outer surface of said container and pivotal relative to said outer surface from a first position wherein said closure when in normal position on said container would not be engaged by said reversible member to a second, reversed position wherein said reversible member would engage said closure when in normal position on said container, said reversible member extending completely around said container.

2. The container of claim 1 wherein said reversible member is a band joined to said container by a relatively thin, circumferentially extending web for pivotal movement about said web when moving from said first position to said second, reversed position.

3. The container of claim 1 wherein said reversible member and said closure include interengaging means to prevent removal of said reversible member from said closure when said container and closure are assembled and said reversible member is in said second, reversed position.

4. The container of claim 3 wherein said container includes a cylindrical body and a closure-receiving open end, wherein said reversible member is joined to said container on said body near said open end, and wherein said interengaging means includes a circumferentially extending bead on said closure and a clasping portion on said reversible member interfitting with said bead.

5. In an assembly of a container having a mouth with arcuate portions defining an opening thereto and a closure having a skirt receiving said mouth and extending at least partially arcuately around the outside of said mouth, improved means for securing said closure to said container comprising a band integrally and pivotally joined to said container by a web with said band extending outwardly from the outside of said container adjacent said mouth, said band having arcuate portions aligned with the arcuate portions of said mouth and said skirt and movable from a first position to a second, reversed position so that in said second, reversed position said band may engage said closure when assembled on said container.

6. A container assembly comprising a molded plastic container having a mouth at least a portion of which is arcuate and defining an opening to said container and a closure having a skirt shaped to be received snugly around said mouth of said container, said closure further having an outwardly directed rib at least a portion of which is arcuate, and means for clasping said closure on said container comprising a peripherally extending band, at least a portion of which is arcuate, integrally joined to the outer surface of said container by a web, said band being integrally molded with said container and, as molded, being located in a first position with a first surface portion thereof facing generally toward the longitudinal axis of said container and a second surface portion thereof facing generally away from said axis, said band being movable from said first position by pivotal movement about said web to a second position wherein said first surface portion faces generally away from said axis and said second surface portion faces generally toward said axis, said band engaging said rib when said band is in said second position to retain said closure on said container.

7. The container assembly of claim 6 having a rupturable portion that may be ruptured to permit access to the contents thereof.

8. The container assembly of claim 7 wherein said rupturable portion comprises a removable panel portion of said closure.

9. The assembly of claim 6 wherein said rib and said band extend completely around said skirt and said container, respectively, so that when said band is in said second position, said band engages along the entire periphery of said rib.

10. The assembly of claim 6 wherein said mouth, said skirt, said rib and said band are all substantially circular.

11. The assembly of claim 10 wherein said rib and said band extend completely around said skirt and said container, respectively, so that when said band is in said second position, said band engages along the entire periphery of said rib.

12. The container assembly of claim 11 having a rupturable portion that may be ruptured to permit access to the contents thereof.

13. The container assembly of claim 7 wherein said rupturable portion comprises a removable panel portion of said closure.

* * * * *

UNITED STATES PATENT OFFICE

CERTIFICATE OF CORRECTION

Patent No. 4171062 Dated Ocotber 16, 1979

Inventor(s) David O. Allen & A. E. Wombold

It is certified that error appears in the above-identified patent and that said Letters Patent are hereby corrected as shown below:

Claim 13, line 1, change "7" to ---12---.

Signed and Sealed this

*Sixth* Day of *May 1980*

[SEAL]

*Attest:*

SIDNEY A. DIAMOND

*Attesting Officer* *Commissioner of Patents and Trademarks*